US007942025B1

(12) United States Patent
Musone

(10) Patent No.: US 7,942,025 B1
(45) **Date of Patent: *May 17, 2011**

(54) COMBINED WASHER DRYER

(76) Inventor: John P. Musone, Orlando, FL (US)

( * ) Notice: Subject to any disclaimer, the term of this patent is extended or adjusted under 35 U.S.C. 154(b) by 470 days.

This patent is subject to a terminal disclaimer.

(21) Appl. No.: 12/082,273

(22) Filed: Apr. 10, 2008

Related U.S. Application Data

(63) Continuation-in-part of application No. 10/426,746, filed on Apr. 30, 2003, now Pat. No. 7,380,423.

(60) Provisional application No. 60/377,668, filed on May 3, 2002.

(51) Int. Cl.
*D06F 25/00* (2006.01)

(52) U.S. Cl. ..... 68/20; 68/142; 34/603

(58) Field of Classification Search ..... 68/20, 142; 34/603

See application file for complete search history.

(56) References Cited

U.S. PATENT DOCUMENTS

| | | | | |
|---|---|---|---|---|
| 1,770,330 | A | | 11/1913 | Clarke |
| 2,151,354 | A | | 3/1939 | Osuch |
| 2,165,884 | A | | 7/1939 | Chamberlin et al. |
| 2,225,407 | A | | 12/1940 | Bassett, Jr. |
| 2,274,121 | A | | 2/1942 | Bendix |
| 2,291,511 | A | | 7/1942 | Traube et al. |
| 2,293,618 | A | * | 8/1942 | Nelligan et al. ..... 68/13 R |
| 2,307,254 | A | | 1/1943 | Bassett, Jr. |
| 2,328,256 | A | | 8/1943 | Breckenridge |
| 2,356,816 | A | | 8/1944 | Breckenridge et al. |
| 2,434,476 | A | | 1/1948 | Wales |
| 2,528,594 | A | | 11/1950 | Kahn |
| 2,530,822 | A | | 11/1950 | Kahn |
| 2,533,888 | A | | 12/1950 | Kahn |
| 2,540,168 | A | | 2/1951 | Kahn |
| 2,555,268 | A | | 5/1951 | Chamberlin |
| 2,607,208 | A | | 8/1952 | Chamberlin |
| 2,607,209 | A | | 8/1952 | Chamberlin |
| 2,612,767 | A | | 10/1952 | Castner |
| 2,648,211 | A | | 8/1953 | Eberlein |
| 2,817,501 | A | | 12/1957 | Schubert |
| 2,823,602 | A | | 2/1958 | Zimarik et al. |
| 2,833,056 | A | | 5/1958 | Smith |
| 2,868,004 | A | | 1/1959 | Rinde |
| 2,892,335 | A | | 6/1959 | Gray, Jr. |
| 2,899,816 | A | | 8/1959 | Jacobsen, Jr. |
| 3,006,176 | A | | 10/1961 | Behrens |
| 3,121,000 | A | | 2/1964 | Hubbard |
| 3,381,507 | A | | 5/1968 | Burgo et al. |
| 3,402,576 | A | | 9/1968 | Krupsky |
| 3,563,693 | A | | 2/1971 | Cohen |
| 3,990,273 | A | | 11/1976 | Scholten et al. |
| 4,663,948 | A | | 5/1987 | Rummel |
| 4,765,162 | A | | 8/1988 | Ouellette |
| 4,903,508 | A | | 2/1990 | Durazzani et al. |
| 4,972,687 | A | | 11/1990 | Czech et al. |
| 5,887,456 | A | | 3/1999 | Tanigawa et al. |
| 6,012,306 | A | | 1/2000 | Raes |

(Continued)

FOREIGN PATENT DOCUMENTS

| | | |
|---|---|---|
| GB | 2 369 423 | 5/2002 |

(Continued)

*Primary Examiner* — Frankie L Stinson

(57) ABSTRACT

A combined washer dryer is provided. The combined washer dryer comprises an outer drum; a variable size inner drum that moves from a first position to a second position effective to increase the inner drum size; a water handling system; and an air handling system.

20 Claims, 11 Drawing Sheets

U.S. PATENT DOCUMENTS

| | | | |
|---|---|---|---|
| 6,032,494 | A | 3/2000 | Tanigawa et al. |
| 6,219,871 | B1 | 4/2001 | Frederick et al. |
| 6,272,770 | B1 | 8/2001 | Slutsky et al. |
| 6,279,357 | B1 | 8/2001 | Didlick et al. |
| 6,282,928 | B1 | 9/2001 | Fukumoto et al. |
| 6,971,189 | B1 | 12/2005 | Anibas |

FOREIGN PATENT DOCUMENTS

| | | |
|---|---|---|
| JP | 32 35 192 | 3/1984 |
| JP | 59-82956 | 5/1984 |
| JP | 8-229280 | 9/1996 |
| JP | 2000-320962 | 11/2000 |
| RU | 1427007 | 9/1998 |

* cited by examiner

COMBINED WASHER DRYER

RELATED APPLICATIONS

This continuation-in-part application claims the benefit of and priority to U.S. patent application Ser. No. 10/426,746, filed Apr. 30, 2003, which in turn, claims the benefit of and priority to U.S. provisional patent application Ser. No. 60/377,668, titled "Combined Washer Dryer" and filed May 3, 2002, which is incorporated by reference herein in their entirety.

FIELD OF THE INVENTION

The present invention relates in general to the field of clothes laundering and, in particular, to a variable size drum combined washer dryer adapted to sequentially wash and dry clothes placed in the drum.

BACKGROUND OF THE INVENTION

There has been appreciable efforts directed toward the design and manufacture of combined washer dryers. Combined washer dryers typically use a single drum arranged along the horizontal axis such that the apparatus is front loading, and are configured to sequentially wash and dry clothes placed in the drum. For example, U.S. Pat. Nos. 2,151,354, 2,291,511, 2,434,476, 2,555,268, 2,607,209, 2,868,004, 2,899,816, 3,006,176, 4,765,162, 4,903,508 and 6,125,490, disclose combined washer dryers. Combined washer dryers also have been commercially sold by various companies such as Equator, Bosch, and Creda.

One problem associated with these combined washer dryers is that they use a drum that is relatively small, typically less than about 2 $ft^3$ and which holds only up to about 10 pounds of clothes. Another problem associated with these combined washer dryers is that they do a relatively poor job in drying the washed clothes and inhibiting wrinkles in the dried clothes. They can also create a relatively high risk of burning the clothes and even cause the clothes of catch on fire. Yet another problem associated with these combined washer dryers relates to their control system that imprecisely and inefficiently controls laundering operations and washer dryer components, thereby causing the washer dryer to use an undesirably large amount of energy and water.

These washer dryer problems, individually or collectively, have inhibited combined washer dryers from entering into the mainstream washer and dryer marketplace (e.g. private residence homes and apartment units with dedicated space for a washer and dryer, self-service laundry facilities, clothes cleaning enterprises), since the mainstream marketplace demands safe and efficient washer dryers capable of accommodating large laundry loads. Thus, combined washer dryers tend to be sold in niche markets that do not demand large laundry load sizes or energy efficient operations, such as single person dwellings, and that adapt the washer dryer to operate in an unconventional manner, such as with kitchen sink piping hookups or without an air vent.

There is thus a need for a combined washer dryer that can address some or all of the needs of the mainstream marketplace. There is also a need for a combined washer dryer that has a larger laundry load capacity. There is also a need for a combined washer dryer with improved drying ability. There is also a need for a combined washer dryer with an improved control system. There is also a need to improve upon the prior art.

SUMMARY OF THE INVENTION

The present invention provides a combined washer dryer that can address some or all of the needs of the mainstream marketplace. The present invention advantageously provides a combined washer dryer that has a relatively large laundry load capacity, and particularly a large drum size for clothes drying. The present invention advantageously also provides a combined washer dryer with improved drying ability. The present invention may also provide a combined washer dryer with an improved control system.

One aspect of the present invention provides a combined washer dryer having a drum that can be varied in size between the wash and dry cycles such that during the wash cycle the drum size is less than the drum size used during the dry cycle, thereby improving air and/or water circulation and accompanying drying quality, water and/or energy efficiency. This can improve laundering by allowing water to more easily flow about the clothes during the wash cycle and/or by allowing air to more easily flow about the clothes during the dry cycle.

Another aspect of the present invention involves a combination washer dryer comprising an outer drum; a rotatable cylindrical variable size inner drum arranged coaxially within the outer drum and movable from a first position to a second position; a water handling system adapted to intake water into the inner drum and to remove water from the outer drum; an air handling system adapted to intake air into the inner drum and to remove air from the outer drum; and a control system adapted to control the movement of the variable size inner drum.

Another aspect of the present invention involves combined washer dryer adapted to sequentially wash and dry clothes placed in a drum, comprising a variable size drum adapted to be movable from a first position to a second position, and to hold an amount of clothes; a controller adapted to control the size of the variable size drum; a washer configured to wash the clothes; and a dryer configured to dry the clothes. Another aspect of the present invention involves a variable size drum adapted for use in a combination washer dryer, comprising a rotatable cylindrical chamber adapted to hold an amount of clothes; and an element arranged within or in unity with the chamber that is movable from a first position to a second position, whereby when the element is moved from the first position to the second position the volume of the variable size drum is changed.

Further aspects, features and advantages of the present invention will become apparent from the drawings and detailed description of the preferred embodiments that follow.

BRIEF DESCRIPTION OF THE DRAWINGS

The above-mentioned and other concepts of the present invention will now be addressed with reference to the drawings of the preferred embodiments of the present invention. The illustrated embodiments are intended to illustrate, but not to limit the invention. The drawings contain the following figures, in which like numbers refer to like parts throughout the description and drawings and wherein.

DETAILED DESCRIPTION OF THE PREFERRED EMBODIMENTS

The invention described herein employs several basic individual or collective concepts. For example, one concept relates to a combined washer dryer that can address some or all of the needs of the mainstream marketplace. Another concept relates to a combined washer dryer that has a relatively large laundry load capacity, and particularly a large drum size for clothes drying. Another concept relates to a combined washer dryer with improved drying ability. Another concept relates to a combined washer dryer with an improved control system. Another concept relates to a combined washer dryer having a variable size drum.

The present invention is disclosed in context of use as a variable size drum combined washer dryer adapted to sequentially wash and dry clothes placed in the drum. The principles of the present invention, however, are not limited to a variable size drum combined washer dryer adapted to sequentially wash and dry clothes placed in the drum. One skilled in the art may find additional applications for the apparatus, processes, systems, components, configurations, methods, and applications disclosed herein. For example, the variable size drum can be used with a stand alone washer or can be used with a stand alone dryer. For another example, a plurality of variable size drums can be used with a washer dryer. For another example, the washer dryer could be used to clean materials or items other than clothes. Thus, the illustration and description of the present invention in context of a variable size drum combined washer dryer adapted to sequentially wash and dry clothes placed in the drum is merely one possible application of the present invention. However, the present invention has been found particularly suitable in connection with a variable size drum combined washer dryer adapted to sequentially wash and dry clothes placed in the drum.

Components

Figure 1:
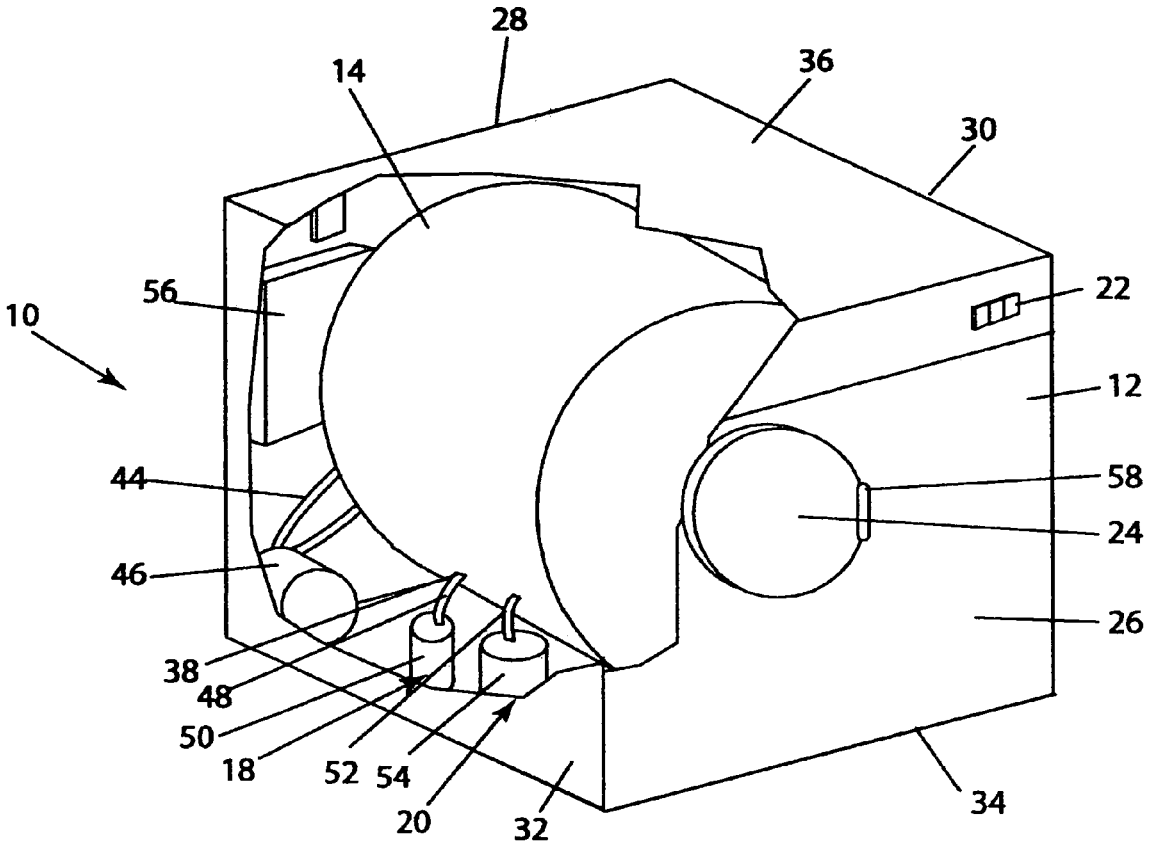
FIG. 1 is a perspective view of an exemplary combined washer dryer having a variable size drum.

With reference now to FIG. 1, a general overview of the components and operation of an exemplary combined washer dryer 10 apparatus of the present invention is provided, followed by a more detailed description of the components and operation. The washer dryer 10 advantageously comprises a housing 12, an outer drum 14, a variable size inner drum 16, a water handling system 18, an air handling system 20, and a control system 22. The illustrated washer dryer 10 is advantageously configured as a horizontal axis (relative to the floor) front clothes loading apparatus, with a door 24 arranged on the front 26 section of the washer dryer 10 for insertion and removal of clothes to be washed and dried. In operation, soiled clothes are placed into the washer dryer 10 and sequentially washed and dried. The size of the inner drum 16 is advantageously varied between the wash and dry cycles such that during the wash cycle the drum 16 size is less than the drum 16 size used during the drying cycle, to improve air and/or water circulation and accompanying drying quality, water and/or energy efficiency.

The illustrated housing 12 is embodied as a conventional cabinet-style structure that houses the working components of the washer dryer 10. This exemplary structure has front 26 and rear 28, right 30 and left 32, and bottom 34 and top 36 sections, which collectively form a three dimensional geometric structure. However, the housing 12 need not be embodied as a conventional cabinet-style structure, need not have any particular sections, and need not form any particular three dimensional geometry. The housing 12 is advantageously constructed of one or more suitably strong, impact resistant materials such as metal, plastic, resin, composites, combinations thereof and the like, for example, sheet metal steel coated with porcelain or paint. Other materials and coatings, for particular purposes such as sound absorption, insulation, corrosion resistance, aesthetics and the like, may also be used. One or more compartments (not shown) may be formed into or with the housing 12 for storage or dispensing of cleaning agents such as detergent, bleach, fabric softener, stain remover and the like, or for general storage of articles such as bottled detergents, mismatched socks and the like.

The outer drum 14 is arranged within the housing 12 and adapted to selectively hold wash water and allow the wash water to exit to along the water handling system 18. One or more openings or drain ports 38 are used to interconnect the outer drum 14 to the water handling system 18. The outer drum 14 advantageously has a cylindrical configuration to increase the amount of clothes, water and/or air that can be accommodated within it when spinning, although other geometries could be used. The outer drum 14 is advantageously constructed of one or more suitably strong, corrosive resistant materials capable of withstanding cyclic centrifugal spin forces of up to about 600-2,500 rpm or more and cyclic water and/or air temperatures of up to about 300° F. or more such as metals, ceramics, plastics, resins, composites, combinations thereof and the like, for example, stainless steel or porcelain, with or without protective coatings. However, the outer drum 14 could also be made of a flexible or resilient material, as explained in more detail below. Although the overall position of the outer drum 14 typically is permanently fixed within the washer dryer 10, it could be configured to be variable sized in a manner similar to that discussed below in connection with the inner drum 16.

The variable size inner drum 16 is arranged within the outer drum 14 and adapted to hold the clothes intended to be washed and dried. A plurality of slits or holes 40 formed through the periphery of the inner drum 16 allows the wash water to exit the inner drum 16 while remaining within the outer drum 14. The inner drum 16 is advantageously connected to a shaft 42 which, in turn, may be connected to a belt, chain or other power transmission device 44 that is driven by a motor 46. Alternatively, the shaft 42 may be directly connected to the motor 46 or otherwise rotated. The motor 46 should advantageously provide either unidirectional or bidirectional rotation to the inner drum 16 (bidirectional increasing clothes agitation options, e.g. back-and-forth rocking motion in addition to one-way spinning). A transmission could be used with a unidirectional motor to provide bidirectional spinning, such as those typically incorporated into conventional top load washers. Like the outer drum 14, the inner drum 16 advantageously has a cylindrical configuration to increase the amount of clothes, water and/or air that can be accommodated within it when spinning, although other geometries could be used. Also like the outer drum 14, the inner drum 16 is advantageously constructed of one or more suitably strong, corrosive resistant materials capable of withstanding cyclic centrifugal spin forces of up to about 600-2,500 rpm or more and cyclic water and/or air temperatures of up to about 300° F. or more such as metals, ceramics, plastics, resins, composites, combinations thereof and the like, for example, stainless steel or porcelain, with or without protective coatings. However, the inner drum 16 could also be made of a flexible or resilient material. A more detailed description of some exemplary embodiments of the variable size inner drum 16 is provided further below.

The inner and outer drums 14, 16 are advantageously coaxially arranged to reduce the overall size of the washer dryer, although there is no requirement to do so. If a coaxial arrangement is used, the outer periphery of the inner drum 16 is spaced about 0.1 inch to about 4 inches apart from the inner periphery of the outer drum 14, preferably about 0.2-1 inch apart. As will be understood by those skilled in the art, this spacing will be largely determined by the particular inner drum shock absorption system used, if any, the particular off-balance load correction mechanism used, if any, and the water efficiency of the washer dyer 10. The inner and outer drums 14, 16 could be arranged at an off-horizontal angle of up to about 25° to assist in the loading of clothes into the combined washer dryer 10 (since the user is typically taller than the open door 24). However, if an off-horizontal angle is used, the water level within the off-angle drum(s) 14, 16 would be uneven unless accommodated for if so desired.

Referring still to FIG. 1, the water handling system 18 is adapted to selectively allow wash water to enter into the inner drum 16, remove wash water from the outer drum 14, purge wash water from the washer dryer 10, and optionally filter and recirculate wash water back into the inner drum 16. The water handling system 18 advantageously comprises one or more conduits, pipes, hoses 48, combinations thereof and the like interconnected by valves, fittings, clamps, washer dryer components and the like in a substantially, preferably completely, watertight manner. One or more pumps 50 or other water mover devices are used to direct the water along the water distribution route. A hose 48 is advantageously arranged to connect to a water source, such as hot and cold water inlet pipes, and to direct this intermixable initial fill wash water into the inner drum 16. A hose 48 is advantageously arranged to direct used wash water from the outer drum 14 out of the washer dryer 10, or to recirculate the wash water back into the inner drum 16. The initial fill or recirculated water could be also used to flush detergents or other cleaning agents from a housing compartment into the inner drum 16 or other purposes, and the drain water could also be used to purge lint traps or and other purposes. Some suitable water handling systems 18 and water distribution routes are described in Chapter 4 of the publication, How To Repair Home Laundry Appliances, Ben Gladdis, TAB Books, 1976, in context of a top load washer, the entirety of this publication which is incorporated by reference herein.

The air handling system 20 is adapted to selectively allow air to enter into the inner drum 16, remove air from the outer drum 16, purge air from the combined washer dryer 10, and optionally reheat/dehumidify and recirculate air back into the inner drum 16. The air handling system 20 advantageously comprises one or more conduits, pipes, hoses, vents, ducts 52, combinations thereof and the like interconnected by valves, fittings, clamps, washer dryer components and the like in a substantially, preferably completely, airtight manner. One or more fans 54 or other air mover devices are used to direct the air along the air distribution route. A duct 52 is advantageously arranged to allow intake air to be heated by an appropriate electrical or gas device such as resistive nichrome wire heating element 56 or a gas burner, and direct the air into the inner drum 16. A duct 52 is advantageously arranged to direct used air from the inner drum 16 out of the washer dryer 10, or to recirculate it back into the inner drum 16. The air could be also used to purge lint traps, exchange heat or humidity, flush agents into the inner drum 16, dry internal components and the like. Some suitable air handling systems 20 and air distribution routes are described in Chapters 7 and 8 of the publication, How To Repair Home Laundry Appliances, in context of a dryer, previously incorporated by reference.

The control system 22 is advantageously used to control some or all washer dryer operations based upon generalized user input such as the clothing type (e.g. cotton, delicate), load size (e.g. small, extra large), water temperature (e.g. cold, warm, hot), drying preferences (e.g. drying time, dryness humidity) and the like. Controlled operations typically include the selection, sequencing and timing of one or more washing and drying cycles such as fill, soak, pre-wash, wash, rinse, spin dry, heat dry, wrinkle-free and the like. One or more cycle variables are also advantageously sensed and controlled by the control system such as water temperature, air temperature, water volume, air humidity, spin speed, rocking agitation, cycle duration, and the like. The control system 22 also advantageously controls at least some washer dryer 10 components such as the motor 46, pump 50, fan 54, heater 56 and the like, as well as the disposition of the variable size drum 16 as explained in more detail below. Some suitable control systems architectures are described in the publication, How To Repair Home Laundry Appliances, in context of a washer and a dryer, previously incorporated by reference. Other suitable control systems and architectures for washing and drying operations are disclosed in U.S. Pat. Nos. 6,484,417, 6,442,979, 6,422,047, 6,349,440, 6,064,043, 6,047,486, 5,929,667, 5,737,852, 5,669,250, 5,444,924, 5,373,714, 5,272,892, 5,265,446, and 5,168,172, each of which are incorporated herein by reference in their entirety. The control system 22 may optionally provide one or more "one touch" inputs so that a user need only touch one button or the display screen once to provide sufficient input to the washer dryer 10 (e.g. extra large load of sturdy cotton colored clothes to be damp dried), and may optionally be user programmable such that a user can define personal washing and drying preferences and "one touch" inputs.

An electronic or electro-mechanical based controller is preferred since mechanical based controllers tend not to provide as precise control over the washer dryer 10 and cause the washer dryer 10 to use a larger amount of energy and water. However, if cost is an important consideration, a mechanical based controller may be preferred. One suitable programmable electronic controller readily available for washer operations and which could be adapted for washer dryer operations as will be understood by those skilled in the art, is a DSP microcontroller commercially available from Analog Devices, Inc. as part number ADMC326 DashDSP with control hardware and circuitry as generally described in the article "DashDSP Simplifies Washing Machine Control System", Aengus Murray, Appliance Magazine, March 2002, which is incorporated by reference herein in its entirety.

Operation

Figure 2:
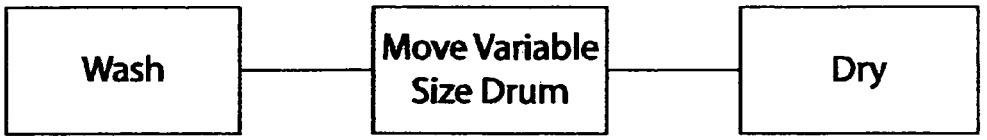
FIG. 2 is a flowchart of an exemplary clothes cleaning operation performed by the combined washer dryer.

Referring now to FIGS. 1 and 2, in an exemplary washer dryer operation, the user inputs clothes cleaning information into the control system 22, places the clothes into the inner drum 16, and secures the door 24. The door 24 may be secured by any suitable mechanism, such as a hinge and latch assembly 58, and locked by the control system 22, manually or remain unlocked. A fill cycle is then initiated with the inner drum 16 in a first position and wash water entering the inner drum 16 via the water handling system 18. The wash water typically has a desired temperature (e.g. about 40-150° F.) and volume (e.g. about 1-25% of the inner drum 16 volume) controlled by the control system 22 based on the user input. After the fill cycle, the inner drum 16 is rotated at one or more speeds (e.g. about 200-1,500 rpm) and/or rocked as directed by the control system 22. After the wash cycle, a spin dry cycle is initiated, where the inner drum 16 is rotated at one or more higher speeds (e.g. 1,000-2,500 rpm) as directed by the control system 22. After (or before) the spin dry cycle, the size of the inner drum 16 is advantageously increased to a second position and a heat dry cycle is then initiated, with air circulating through the inner drum 16 via the air system 20 at a desired temperature (e.g. about 80-300° F.) until a desired humidity (e.g. about 0-50%) or a desired time duration (e.g. about 10-180 minutes) is attained within the inner drum 16, as directed by the control system 22. Increasing the size of the inner drum 16 allows air to more easily circulate about the clothes during the heat dry cycle, thereby improving clothes drying. After the heat dry cycle, a buzzer or other sensory indicator may be used to indicate that the washer dryer operation is complete.

As will be understood by those skilled in the art, the washer dryer operation could repeat or use other or additional cycles, such as a prewash cycle (e.g. soak with low speed agitation) prior to the wash cycle, or wrinkle-free cycle (e.g. low speed or intermittent low heat tumble) after the heat dry cycle. Also, other steps, sequences or activities as provided above or understood by those skilled in the art could be used, for example, detergent or other cleaning agents could be dispensed from housing compartments into the inner drum 16. Also, one or more of the cycles, steps, sequences or activities provided above could be varied such that it is before or after one or more other cycles, steps, sequences, activities provided above or repeated. Although the above example explains moving the inner drum 16 either between the spin dry and heat dry cycles or between the wash and spin dry cycles, the inner drum 16 could be moved between one or more other or different cycles. Additionally, the quantified ranges provided above are merely exemplary of typical clothes washing and drying conditions and should not be considered as limiting washer dryer operations to within these exemplary ranges.

Variable Size Drum

With reference now to FIGS. 3-12, some exemplary embodiments of the variable size drum 16 are now provided. These embodiments are provided only to demonstrate and describe some exemplary variable size drums 16, and in no way are intended to limit the scope of this invention to variable size drums 16 configured in accordance with or in manner similar to these exemplary embodiments. Rather, the invention broadly contemplates any variable size drum 16 described and contemplated by this disclosure. Also, those skilled in the art will readily appreciate and understand other embodiments of and modifications to the exemplary embodiments now provided, and such other embodiments and modifications fairly lie within the spirit and scope of this invention.

As explained above, the variable size drum 16 is advantageously sized and configured to have an overall cylindrical shape with holes 40 and is surrounded by a larger holding drum 14 (which could have a fixed size or also be variable sized). The drum 16 is modifiable in dimensional configuration to have a variable size or volume amount of clothes holding capacity. One way to provide the variable size drum 16 is to adapt at least a portion of the drum 16 to be movable and/or to be variable in size from at least a first position to at least a second position. The control system 22 preferably controls this movability or size variability such that it 22 generally "knows" the present size of the drum 16 and can move or vary it 16 from one position to another position, thereby directing other aspects of the clothes cleaning operation (e.g. water intake, air circulation) with a known size capacity drum 16 for increased efficiency and/or performance. However, the control system 22 need not control or be capable of controlling the movability or size variability of the drum 16. And the drum 16 can be instead manually moved or varied.

Example 1

Figure 3A:
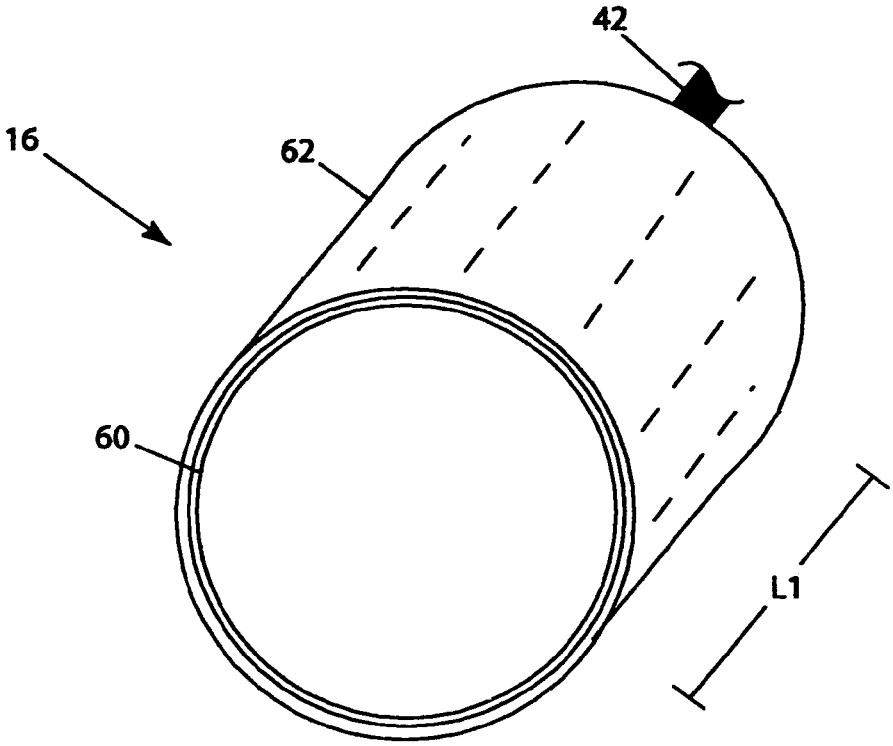
FIG. 3A is a perspective view of an exemplary variable size drum comprising a first portion and a second portion, and showing the drum in a retracted position.
Figure 3B:
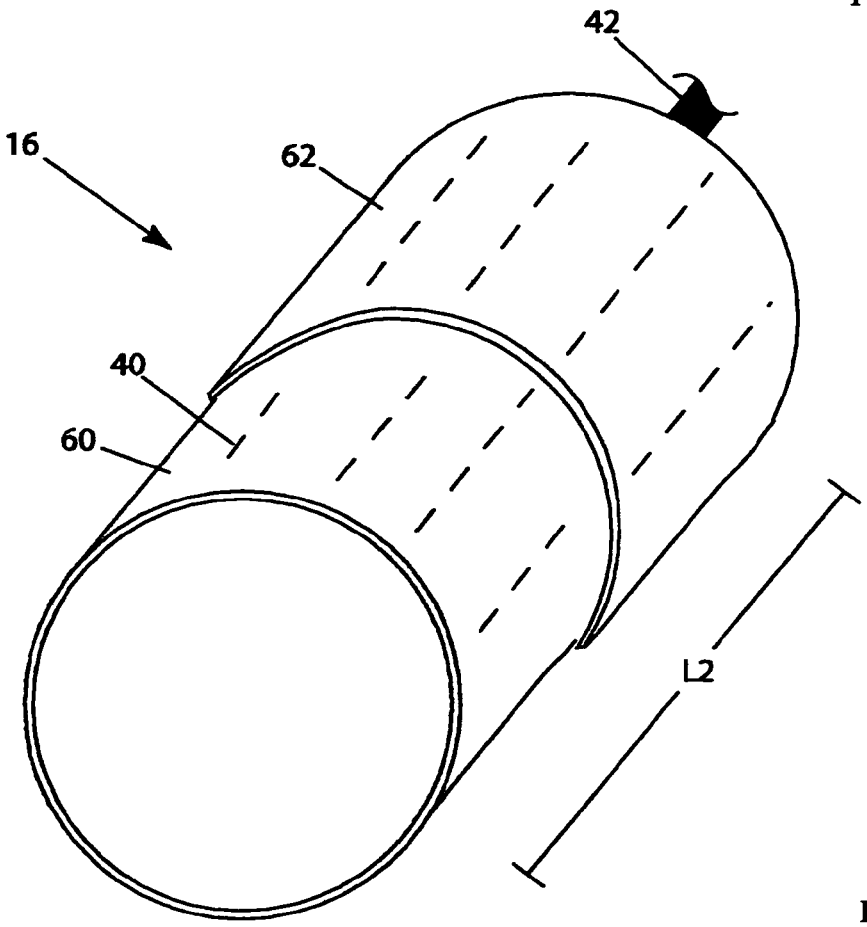
FIG. 3B is a perspective view similar to FIG. 3A, and showing the variable size drum in an extended position.
Figure 4A:
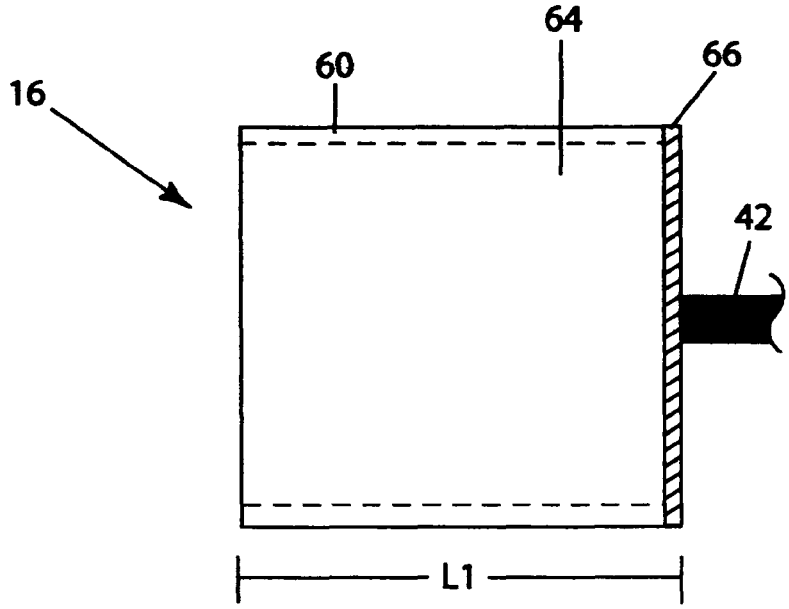
FIG. 4A is a side elevation view of the variable size drum of Figure
Figure 4B:
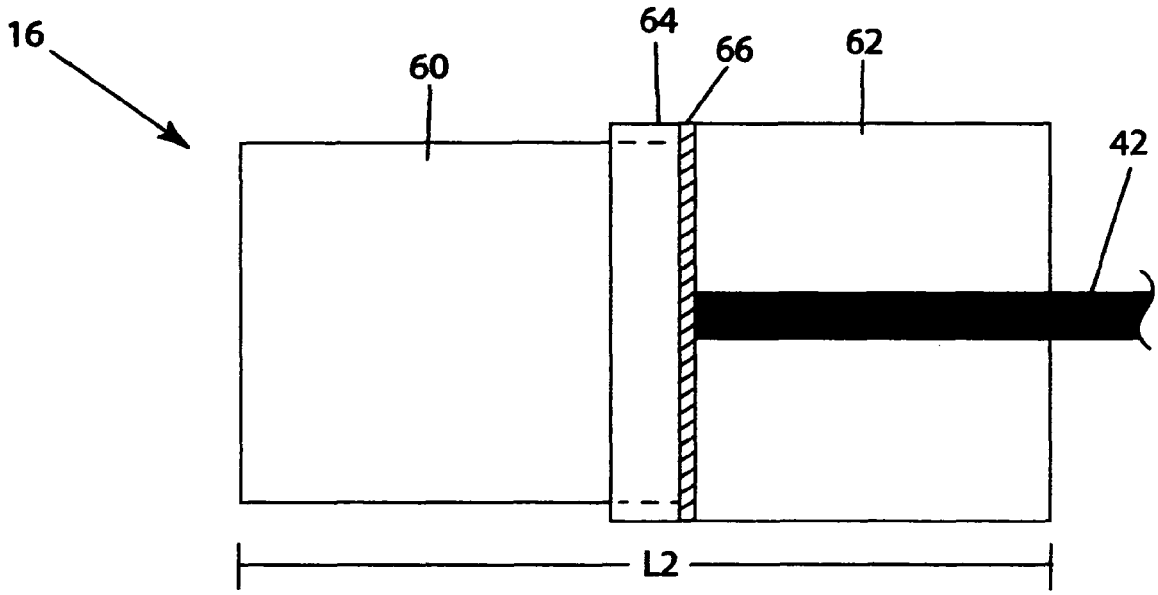
FIG. 4B is a side elevation view of the variable size drum of FIG. 3B.

FIGS. 3A, 3B, 4A and 4B show a cylindrical drum 16 having a variable length. Referring to FIGS. 3A and 4A the drum 16 has a first length L1, and referring to FIGS. 3B and 4B the drum 16 has a second larger length L2. The length of the drum 16 can be varied by adapting the drum 16 from the L1 retracted position configuration to the L2 extended position configuration, and vice-versa. Of course, the drum 16 size can also be varied to many other lengths by adapting the drum 16 from positions other than L1 to positions other than L2. Some exemplary suitable ways of achieving this lengthwise adaptation are provided below.

One way to achieve this lengthwise variation is by configuring a first portion 60 of the drum 16 to be coaxially overlapped by a second portion 62 of the drum 16 (or vice-versa), providing an overlapping region 64. As illustrated, the diameter of the first portion 60 is slightly smaller (e.g. about 0.1-1 inch) than the second portion 62, although a larger or smaller annular spacing could also be used. When in a retracted position (FIGS. 3A and 4A), the first portion 60 may be completely or partially overlapped by the second portion 62. One or more annular seals 66 are advantageously arranged within the annular space between the first and second portions 60, 62 to inhibit water, air and/or clothes from unintentionally exiting the drum 16. If used, the seal 66 need not be annular and need only be arranged along or near at least a portion of the first or second portions 60, 62. As will be understood by those skilled in the art, the portions of the drum 16 need not be limited to first and second portions 60, 62 but may comprise more than two portions, any number of which may overlap which any number of other portions to produce a plurality of overlapping regions 64.

Still referring to this exemplary configuration illustrated by FIGS. 3A, 3B, 4A and 4B, the first portion 60 is connected to the shaft 42 driven by the motor 46, and the second portion 62 configured to directly or indirectly interengage with the first portion 60 such that the rotational torque provided to the first portion 60 by the shaft 42 is transferred to the second portion 62. However, many alternative arrangements could be used as understood by those skilled in the art. For example, the second portion 62 can be independently driven by another coaxially (or otherwise) arranged shaft. Alternatively, the shaft 42 can drive the second portion 62, with the second portion 62 interengaging with and driving the first portion 60. If the first and second portions 60, 62 interengage, such interengagement can be achieved by any suitable interengagement mechanism, device or means, such as one or more permanent or retractable teeth or protuberances that extend into mating slots or holes (not shown).

The first portion 60 is made movable by directly or indirectly connecting it to a lengthwise telescoping shaft 42. Any suitable type of telescoping shaft can be used, one such suitable embodiment being described in U.S. Pat. No. 4,133,190 which is incorporated by reference in its entirety, in context of use with a cardan shaft drive. Another such suitable embodiment being described in U.S. Pat. No. 4,470,527 which is incorporated by reference in its entirety, in context of use with a wig mount.

Figure 5:
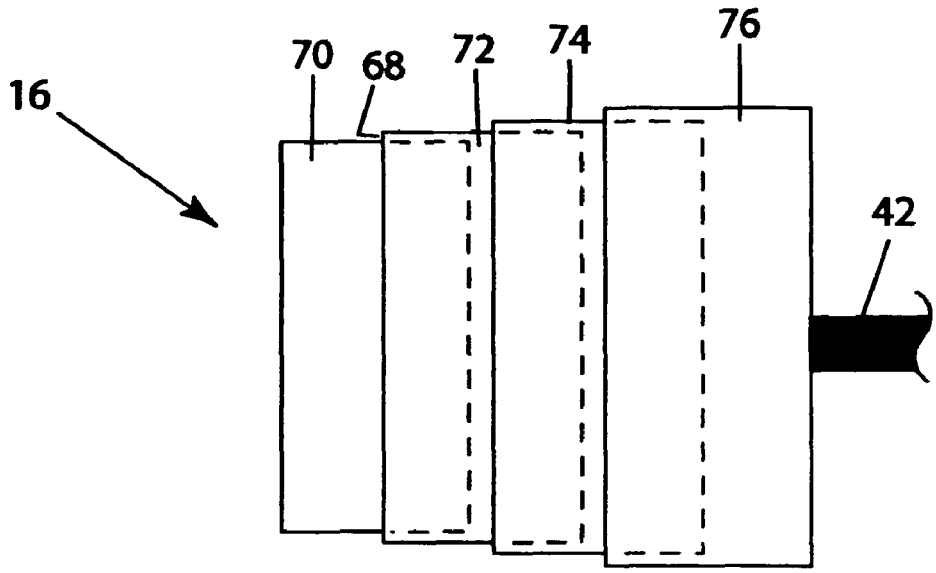
FIG. 5 is a side elevation view of another exemplary variable size drum comprising a plurality of telescoping sections.

Referring to FIG. 5, another way to achieve this lengthwise variation is by configuring the drum 16 as a unitary member with at least one section of the length of the drum 16 telescoping another section of the length of the drum 16. By this configuration, when the drum is in the L1 position, a telescoping section is in an retracted position, and when the drum is moved from the L1 position towards the L2 position a telescoping section is moved to an extended position to provide a drum 16 having a different size or dimensional configuration (and vice-versa). Thus, for example, the drum 16 could be configured with one or more radial steps 68 that provide for coaxial telescoping sections 70, 72, 74 and 76. Any suitable type of telescoping configuration can be used.

Figure 6:
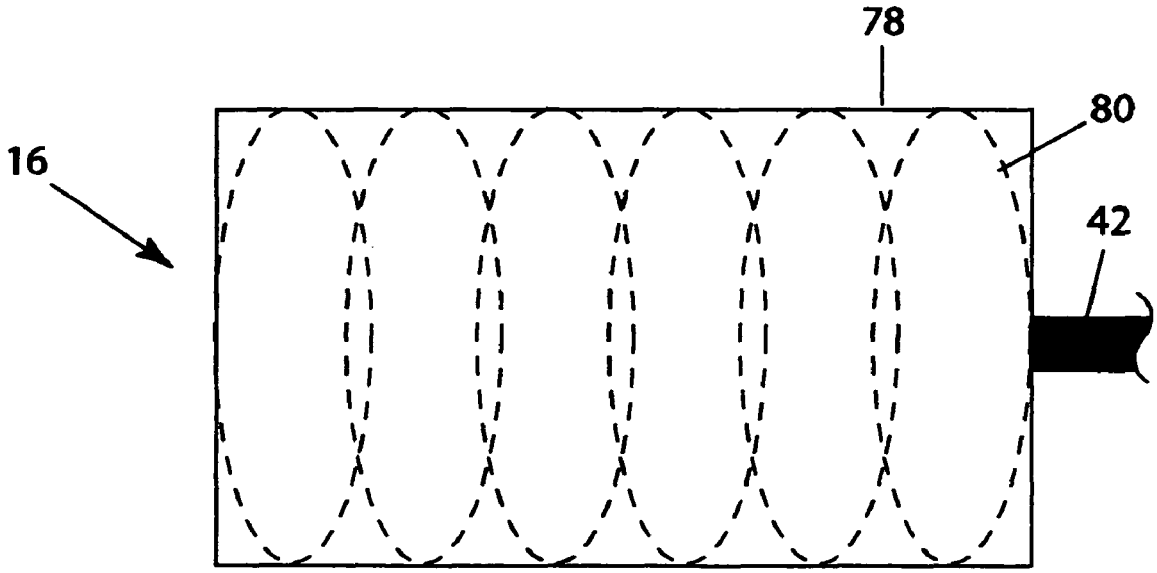
FIG. 6 is a side elevation view of another exemplary variable size drum comprising a resilient or deformable material.

Referring to FIG. 6, another way to achieve this lengthwise variation is by configuring at least a portion of the length of the drum 16 material to be resilient or deformable, such that it can be compressed, pulled, bent, biased or urged relative to another portion of the drum 16 or another element of the washer dryer 10 (e.g. front 26 or rear 28 of the housing 12). By this configuration, the drum can be moved from the L1 position to the L2 position (and vice-versa) by a telescoping shaft or other suitable mechanism or means to provide a drum 16 having a variable size or dimensional configuration. Thus, for example and as shown, the entire drum 16 could be configured from a suitably strong yet resilient plastic or composite material 78 optionally reinforced by an embedded or overlying helical or otherwise dimensionally arranged plastic, metal or composite support material 80. For another example, only a portion of the drum 16 could comprise the material 78.

Example 2

Figure 7A:
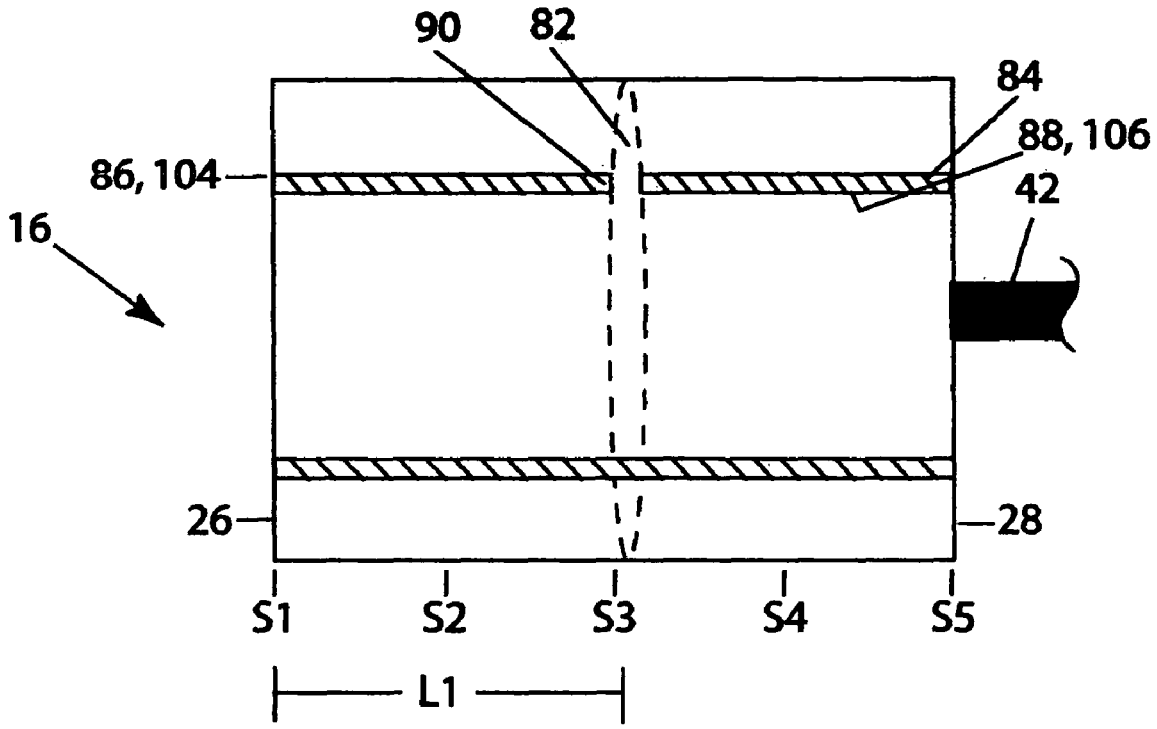
FIG. 7A is a side elevation view of another exemplary variable size drum comprising a moveable wall arranged between front and rear ends of the drum, guided by a guidance mechanism and driven by an actuating force, and showing the variable size drum in a retracted position.
Figure 7B:
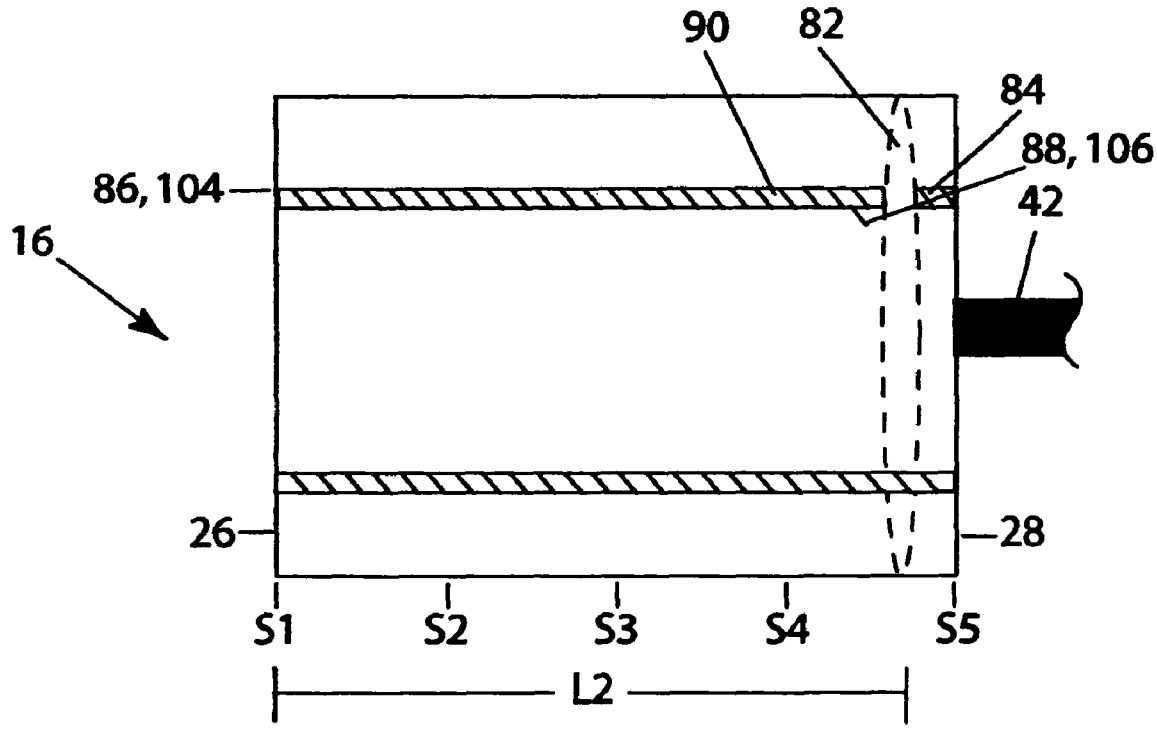
FIG. 7B is a side elevation view similar to FIG. 7A, and showing the drum in an extended position.

FIGS. 7A and 7B show a cylindrical drum 16 having a moveable wall 82 disposed between the front and rear ends 26, 28 of the drum 16. The moveable wall 82 is advantageously linearly guided by a guidance mechanism 84 and urged by an actuating force 86 to provide a variable length drum 16. Referring to FIG. 7A the drum has a first length L1, and referring to FIG. 7B the drum has a second larger length L2. The length of the drum can be varied by adapting the drum 16 from the L1 retracted position configuration to the L2 extended position configuration, or vice-versa. Of course, the drum 16 size can also be varied to many other lengths by adapting the drum 16 from positions other than L1 to positions other than L2. Some exemplary suitable ways of achieving this variable length are provided below.

One way to achieve this variable length is by configuring the guidance mechanism 84 as comprising a fixed guide 88 that is operatively associated with a moveable member 90. The fixed guide 88 is advantageously attached to or formed in unity with or otherwise arranged along at least a portion of the length of the drum 16 periphery, and a moveable member 90 is advantageously adapted to roll, slide, advance or otherwise move along, within or otherwise relative to the fixed guide 88. The illustrated embodiment shows a conventional shaft 42 attached to the rear 28 of the drum 16 in a conventional manner such that the rear 28 of the drum 16 is not lengthwise moveable, and the moveable wall 82 attached to the moveable member 90 of the guidance mechanism 84 but not connected to the shaft 42 and to be lengthwise moveable. By this configuration, the moveable wall 82 is adapted with lengthwise traverse along at least a portion of the drum length 16.

The guide 88 preferably has a plurality of stop locations, e.g. S1, S2, S3, S4, S5 where the moveable member 90 can be selectively secured or locked to provide the moveable wall 82 with limited or unlimited lengthwise positioning, although no such stop locations S are required. These stop locations S can be either physically predetermined, such as by forming recesses, holes or notches 94 in the guide 88 that interengage with mating elements such as protuberances, tabs or teeth 96 in the moveable member 90 (or vice-versa) (FIG. 10), or determined by the application or nonapplication of the actuating or driving force 86 on the moveable member 90. Any suitable actuating force 86 can be used such as electrical wire, electrical busbar, pneumatics, hydraulics, motors, batteries, springs, screws, magnets, manually, combinations thereof and the like.

Figure 8:
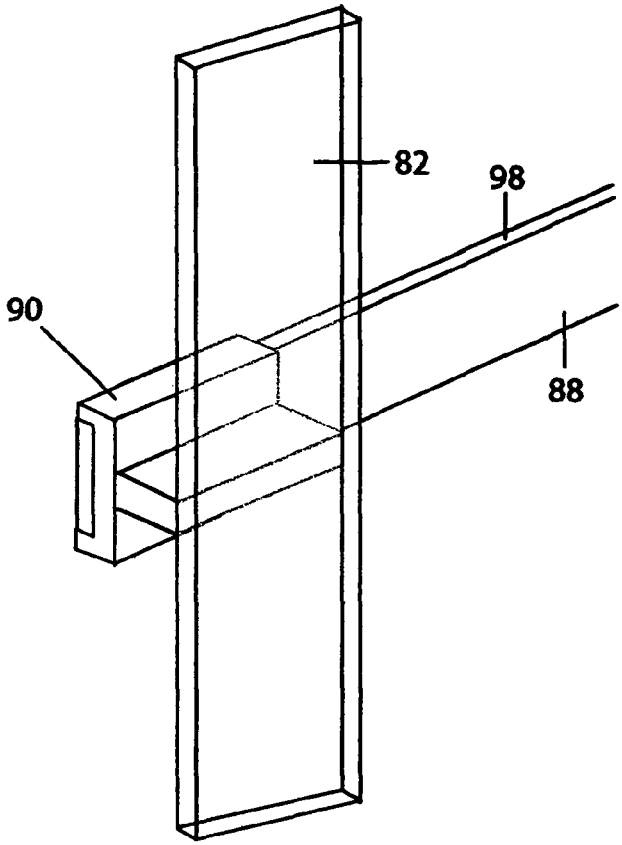
FIG. 8 is a detail view of an exemplary guidance mechanism comprising a linear rail guide.

Referring to FIG. 8 for an illustrated example of a suitable fixed guide 88 and moveable member 90, a linear rail guide 98 is shown. The linear rail guide provides for lengthwise traverse of the moveable wall 82. One suitable linear rail guide 98 is described in the marketing brochure catalog B-01 "Manual and Motorized Bi-Slide High Precision Linear Motion Components" by the Velmex, Inc. company, which is incorporated by reference in its entirety, and can use a NEMA 23 motor to provide the actuating force. Other suitable linear rail guides 98 are described in U.S. Pat. Nos. 4,932,067 and 6,149,308, both of which are incorporated by reference in their entirety. Other suitable linear rail guides 98 include those commercially available from Thomson Industries, Inc. under the tradenames AccuMax and AccuGlide, and from the Pacific Bearing company under the tradename Redi-Rail, and the like.

Figure 9:
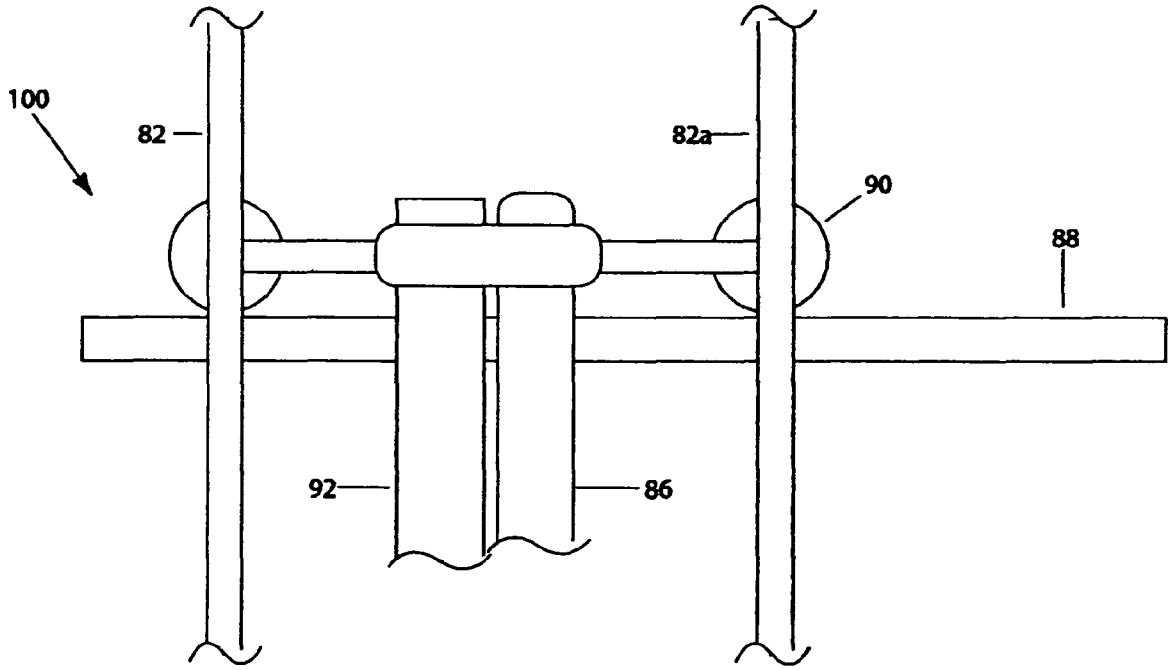
FIG. 9 is a detail view of another exemplary guidance mechanism comprising a trolley track busway.

Referring to FIG. 9 for another illustrated example of a suitable fixed guide 88 and moveable member 90, a trolley track busway 100 is shown. One suitable trolley track busway 100 is commercially available from the Universal Sewing Company under the tradename Electro-Rail, and from US Safety Trolley Corporation, a division of Universal Electric Corporation, under the tradenames Starline, Span-Guard and SmartRail. This example further illustrates a motor 86 and location sensor 92 attached to a pair of moveable members 90. The motor 86 provides the actuating force 86 while the sensor 92 tracks the location of itself or the moveable wall 82 as part of the control system 22. A second moveable wall 82*a* is also exemplary illustrated.

Figure 10:
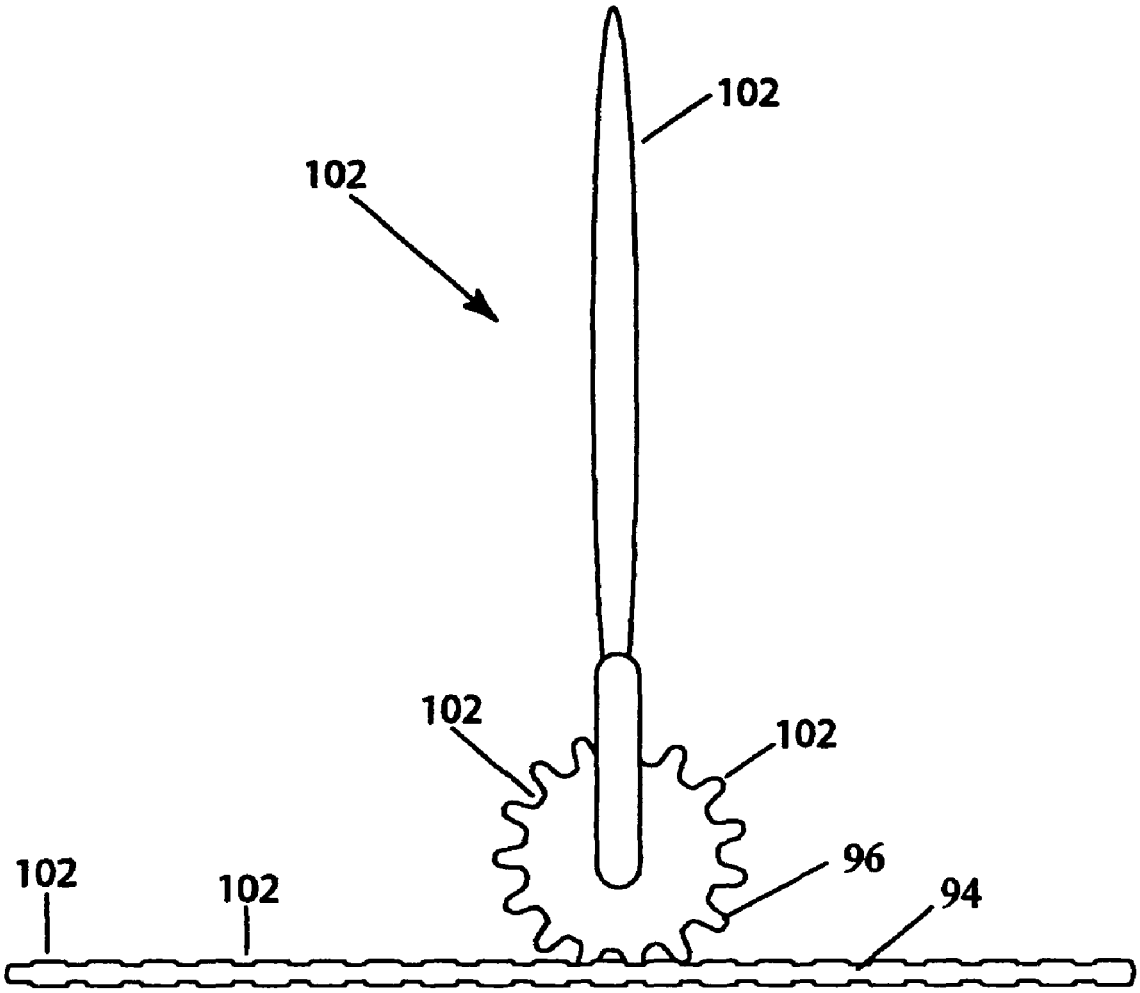
FIG. 10 is a detail view of another exemplary guidance mechanism comprising a rack and pinion assembly.

Referring to FIG. 10 for another illustrated example of a suitable fixed guide 88 and moveable member 90, a rack and pinion assembly 102 is shown. One suitable rack and pinion assembly 102 is described in U.S. Pat. No. 5,492,050 in context of use with a pneumatic actuator, and U.S. Pat. No. 5,492,414 in context of use with a linear ball slide, both of which are incorporated by reference in their entirety. This example further illustrates a plurality of permanent notches 94 and teeth 96 that interengage to provide stop locations S.

Figure 11:
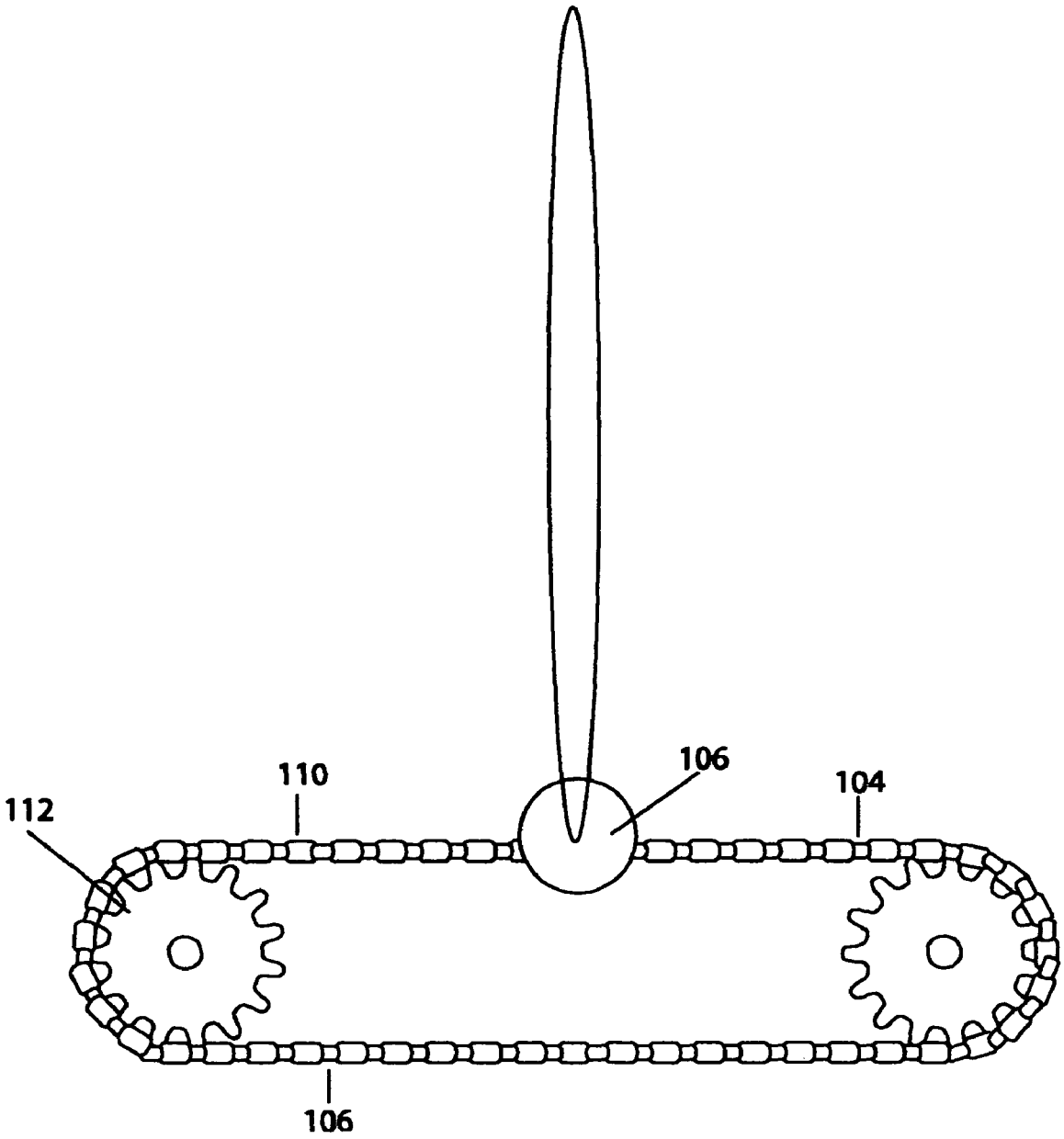
FIG. 11 is a detail view of another exemplary guidance mechanism comprising an endless chain.

Referring back to FIGS. 7A and 7B and now also to FIG. 11, another way to achieve this variable length is by configuring the guidance mechanism 84 as comprising a moveable guide 104 that is operatively associated with a fixed member 106, and having the actuating force 86 provide movement to the moveable guide 104. The moveable guide 104 is advantageously adapted to move along, within or otherwise relative to at least a portion of the length of the drum 16 periphery, and the fixed member 106 is advantageously attached to or formed in unity with or otherwise arranged along at least a portion of the moveable guide 104. By this configuration, the moveable wall 82 is adapted with lengthwise traverse along at least a portion of the drum length 16.

Referring to FIG. 11 for an illustrated example, one suitable moveable guide 104 and fixed member 106 embodiment that can be used is an endless chain or belt 108 formed with one or more links 110 and driven by one or more cogs or rollers 112 that, in turn, are driven by a shaft, belt, chain, motor or other actuating force 86. The cogs 112 are advantageously attached to the interior of the drum 16 and the links 112 form an endless chain around the cogs 112 along the length of the drum 16. The moveable wall 82 is directly or indirectly attached to or formed in unity with one or more links 112. By reversing and alternating the direction of the chain 108, the links 112 and moveable wall 82 are made to move linearly, or the chain 108 can be moved unidirectionally. A suitable endless chain embodiment is described in U.S. Pat. No. 6,421,938 which is incorporated by reference in its entirety, in context of use with a cutting device.

One or more of the exemplary guidance mechanisms (e.g. linear rail guide 98, trolley track busway 100 rack and pinion assembly 102, endless chain 108) illustrated and described above, or other suitable guidance mechanisms, preferably 1-10, are advantageously directly or indirectly connected to periphery of the moveable wall 82 to guide the moveable wall 94 such that is it moveable or variable in location, as illustrated and described above. Of course, additional moveable walls or portions of the drum 16 other than or in additional to the moveable wall 82 could also be used to provide the lengthwise traverse from L1 to L2, such as a front or side 26, 30 wall or portions thereof. Many other guidance mechanism configurations can be used, such as arranging some or all of the guidance mechanism elements (e.g. fixed guide 88 or cogs 112) on the exterior to the drum 16 to conserve space within the drum 16 and to not expose the clothes to it 88, 112. Also, one or more annular seals could be disposed in the annular space between the moveable wall 82 and the drum 16 periphery. Preferably, portions of the guidance mechanism 84 and actuating force 86 that are exposed and succeptable to wash water, such as an electrically conductive busbar that could be used with the linear rail guide 98 or trolley track busway 100, are waterproofed as will be understood by those skilled in the art. Many other guidance mechanisms could be used and fairly lie within the spirit and scope of the present invention. For example, a conduit or pipe could function as the fixed guide 88 while the leading edge of a pneumatic gas (e.g. air) or hydraulic fluid (e.g. water) could actuate or drive the moveable member 90 or function as the moveable member 90. For another example, a helical wire could function as the moveable guide 104. Like with Example 1 above, the guidance mechanism 84 and actuating force 86 is preferably controlled at least in part by the control system 22, although it need not be so controlled.

Example 3

Figure 12A:
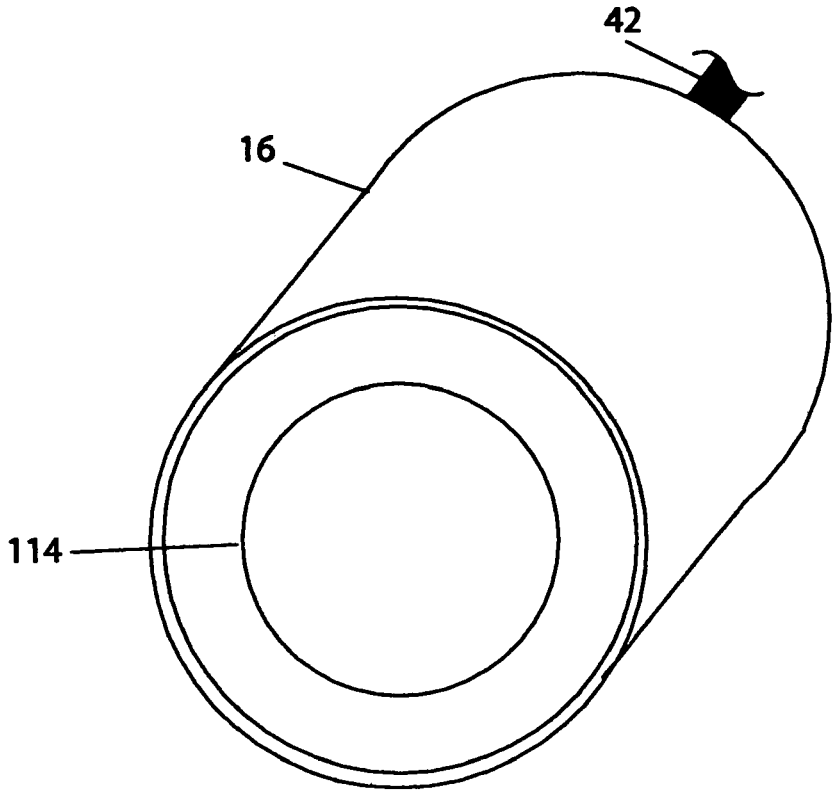
FIG. 12A is a perspective view of another exemplary variable size drum comprising a variable diameter, and showing the variable size drum in a retracted position.
Figure 12B:
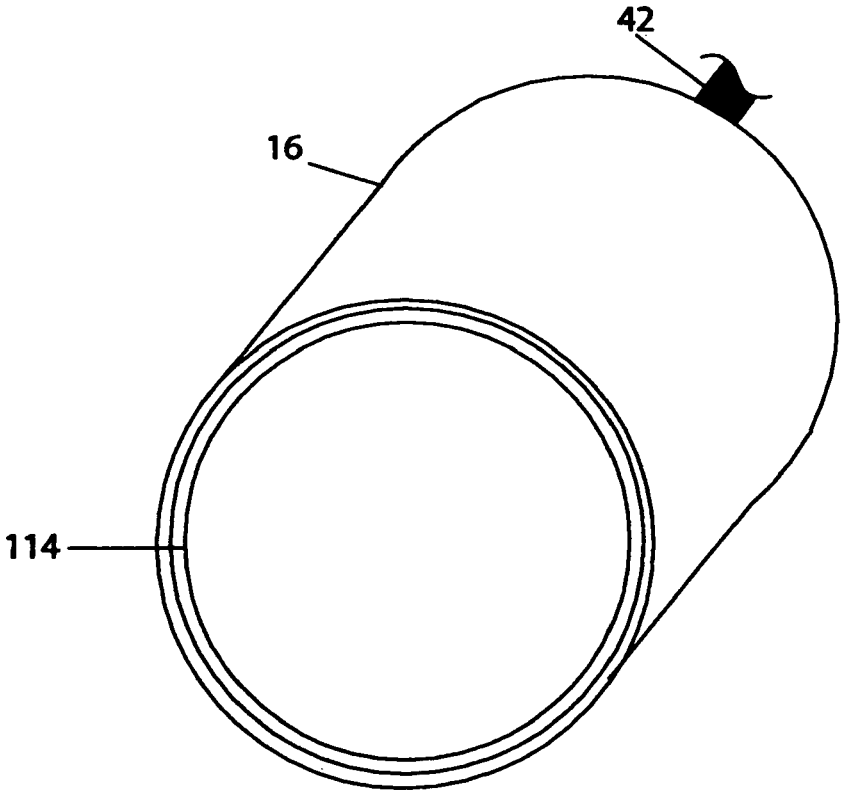
FIG. 12B is a perspective view similar to FIG. 12A, and showing the variable size drum in an extended position.

FIGS. 12A and 12B show a cylindrical drum 16 having a variable diameter. Referring to FIG. 12A the drum 16 has a first diameter D1, and referring to FIG. 12B the drum has a second larger diameter D2. The diameter of the drum 16 can be varied by adapting the drum from the D1 retracted position configuration to the D2 extended position configuration, or vice-versa. Of course, the drum 16 size can also be varied to many other diameters by adapting the drum 16 from positions other than D1 to positions other than D2. Some exemplary suitable ways of achieving this diameterwise adaptation are provided below.

Like with Examples 1 and 2, there are many ways to achieve this diameterwise adaptation. For example, one way is by configuring a first region of the drum 16 to overlap a second region of the drum 16, thereby producing a diameterwise overlapping portion. Another way to achieve this diameterwise adaptation is by configuring the drum 16 as a unitary member with at least one region of the diameter of the drum 16 telescoping at least one other region. Another way to achieve this diameterwise adaptation is by configuring at least a portion of the diameter of the drum to be resilient or deformable. Another way to achieve this diameterwise adaptation is by arranging a radially moveable wall 114 between the center and periphery of the drum 16.

Although Examples 1-3 show the size of the drum variable either lengthwise or diameterwise, the drum size can also be varied in many other ways, such as by a combination of the lengthwise and diameterwise modifications. Also, if a noricylindrical drum is used, the drum size can be nonsymmetrical, similarly or otherwise modified.

As noted above, the outer drum 14 can be adapted to be variable in size in a mariner similar to that described with the inner drum 16. One advantage of adapting the outer drum 14 also to be moveable and remain slightly larger than the inner drum 16 size is that such a configuration reduces the amount of water located annularly between the inner and outer drums 14, 16 during the soak and wash cycles, thereby assisting in reducing the overall amount of water used and increasing efficiency.

One advantage of using a variable size inner drum 16 is that it allows a user to partially or completely fill the drum 16 with clothes and then set the combined washer dryer 10 to a desired wash and dry cycle. The control system 22 can then direct the machine 10 to wash the clothes with the drum 16 in a first position based on the user input to improve washer efficiency and reduce the amount of water used. After the wash cycle, the control system 22 can dry the clothes with the drum 16 in its present position or can move the drum 16 to a second position, typically with a larger size so that air can more freely flow or pass about the clothes to improve dryer efficiency and reduce drying time.

The inner drum 16 advantageously can be adapted to move and provide a drum 16 that can vary in size from a completely extended position to a completely retracted position. If used for conventional housing units with dedicated space for a washer and dryer, typical drum 16 size variation for a large laundry load is likely to be from about 3-5 $ft^3$ during the wash cycle to about 6-10 $ft^3$ during the dry cycle, and for a small laundry load is likely to be from about 1-2 $ft^3$ during the wash cycle to about 2-4 $ft^3$ during the dry cycle. However, the drum 16 could be easily configured to provide for much larger or smaller cubic footage. Also, the drum 16 size can be varied before, during or after any one or more of the laundering cycles, including the fill cycle, wash cycle, spin cycle, dry cycle, wrinkle free cycle and the like.

In another aspect of the present invention, the combined washer dryer 10 has at least one visual or other indicia (e.g. line, word, phrase, marking, drawing) arranged on the interior of inner drum 16 indicative of how high clothes can be placed or filled within the inner drum 16 to help ensure that the washer dryer 10 is not overfilled with clothes and thus increase efficiency of the washer and dryer. A plurality of indicia may be used, with different indicia indicating preferred fill amounts for different load sizes, such as large, medium and small. Alternatively, only a maximum fill indicia could be used. For example, a large load indicia could be arranged such that when the clothes are stacked relatively evenly high within the inner drum 16, about 75-95% of the inner drum 16 volume is occupied by clothes. This exemplary percentage range may account for or not account for the user cramming clothes on top of other clothes to thereby increase the effective density of the clothes, or for the thickness and density of the clothes themselves. For another example, a small load indicia could be arranged indicating that less than about 33% of the inner drum 16 volume is occupied by clothes. The indicia could also advantageously assist the user in determining laundry load size and thus the user input into the control system 22. The indicia could also be arranged on locations other than or in addition to the interior of the inner drum 16, such as on the door 24, housing 12, rear wall of the inner drum 16, combinations thereof and the like. The indicia need not be used with a combined washer dryer having a variable size drum, and could be used with any conventional washer dryer, washer or dryer.

In another aspect of the present invention, the combined washer dryer 10, has a door 24 arranged such that when clothes are stacked too high inside the inner drum 16 prior to beginning washer dryer 10 operations such that poor drying or cleaning will likely result, some clothes would likely naturally fall out of the inner drum 16 via the open door 24 as the user attempts to overfill the inner drum 16 prior to beginning washer dryer 10 operations. One way to provide such a door arrangement is to locate the height of the door 24 in a manner generally similar to the maximum fill indicia described above. For example, the bottom of the door 24 could be arranged at a height such that when about 75-95% of the inner drum 16 volume is occupied by clothes, or about 75-95% of the height of the inner drum 16 is occupied by clothes, additional clothes will likely naturally fall out of the open door 24. For another example, the midpoint height of the door could be arranged at a height not less than 50% of the height of the inner drum 16, preferably between 70-80%. The door can have any suitable geometrical configuration, with the geometric configuration advantageously assisting in the natural fallout of overfilled clothes, such as round, oval, square, rectangular, triangular and the like. The above-described door 24 need not be used with a combined washer dryer having a variable size drum, and could be used with any conventional washer dryer, washer or dryer.

Figure 13:
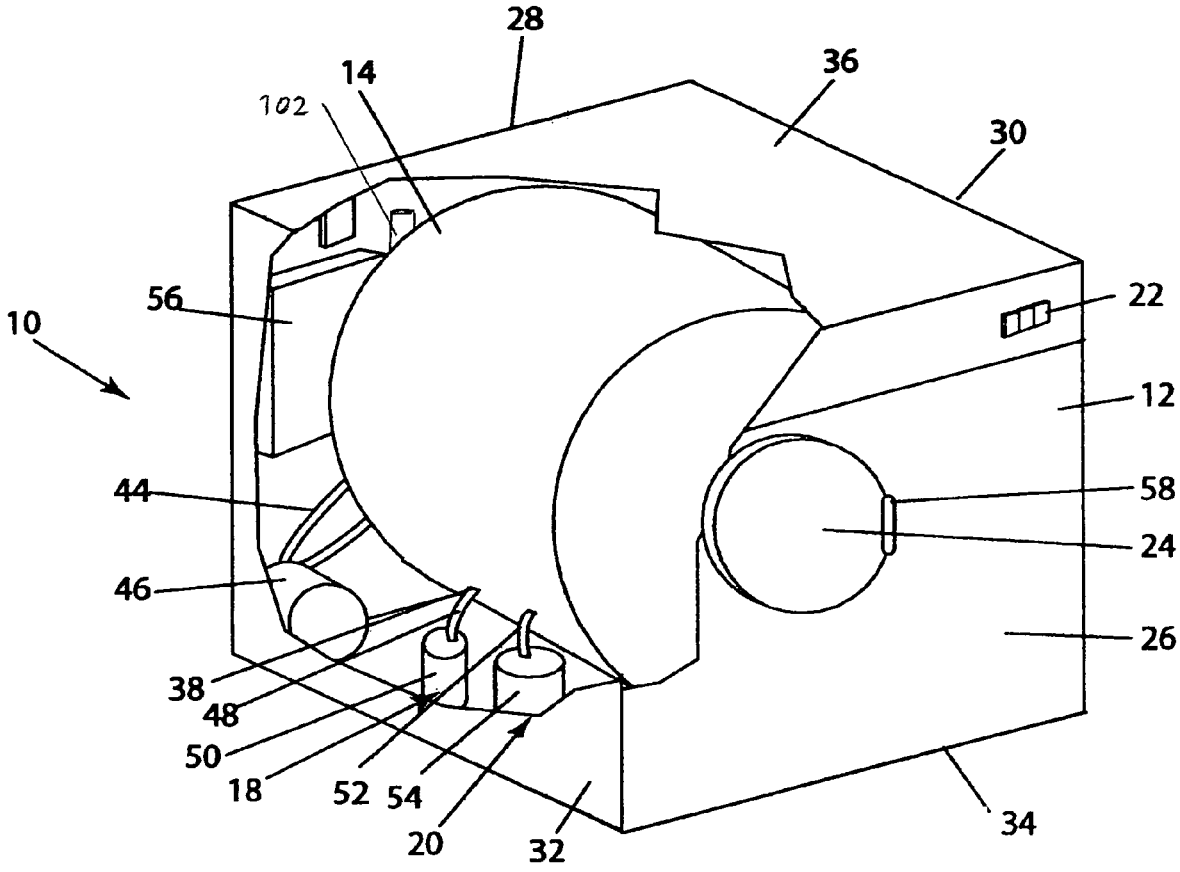
FIG. 13 is a perspective view similar to FIG. 1, and showing the combined washer dryer with a supplemental drying mechanism.

Referring to FIG. 13, the washer dryer 10 may optionally include a supplemental drying mechanism 102 as an exemplary supplement to or replacement of the heat drying in order to remove the wash water from the clothes after the wash cycle. The supplemental drying, however, need not supplement the heat drying. For example, the heat drying may be the sole mechanism to remove the wash water from the clothes. For another example, the supplemental drying may be used in lieu of the heat drying such that it is the sole mechanism to remove wash water from the clothes. However, as one skilled in the art may appreciate, supplementing the heat drying with the supplemental drying mechanism may be preferred in order to decrease overall drying time and, depending on the particular supplemental drying mechanism and application, may also improve drying efficiency and quality (e.g. less harm to the clothes fabrics). If used, the supplemental drying may occur during the heat dry cycle, or before or after the heat drying cycle as a separate portion of the dry cycle, or as a combination thereof. Decreased drying time can further improve one of the benefits of a combined washer drying, namely further decreased overall laundering time.

Suitable supplemental drying mechanisms 102 include but are not limited to those that utilize energy application sources such as microwave, ultraviolet, infrared, ultrasonic and the like. For example, microwave energy directly heats up and evaporates the water molecules within the clothes while imparting relatively small amounts of heat to the lower density clothes. If desired, the microwave drying can be made even more efficient by reducing the pressure within the inner drum to below atmospheric pressure. Use of microwave clothes drying has been discussed in U.S. Pat. No. 3,854,219, U.S. Pat. No. 4,250,628, and U.S. Pat. No. 6,272,770, each of which are incorporated by reference in their entirety. For another example, infrared energy has a frequency between microwave and visible light. Although infrared has a lower frequency and energy amount than microwave, like microwave energy, infrared energy more directly and efficiency heats up and evaporates the clothes than traditional heat drying. A benefit of infrared over microwave is that infrared does not cause metal arcing. Use of infrared energy clothes drying has been discussed in U.S. Pat. No. 5,953,831, which is incorporated by reference in its entirety. For another example, ultrasonic energy may be advantageous for handling delicate clothes and for breaking large water aggregates into smaller units. Use of ultrasonic energy clothes drying has been discussed for use in conjunction with microwave energy is U.S. Pat. No. 4,057,907, which is incorporated by reference in its entirety.

Figure 14A:
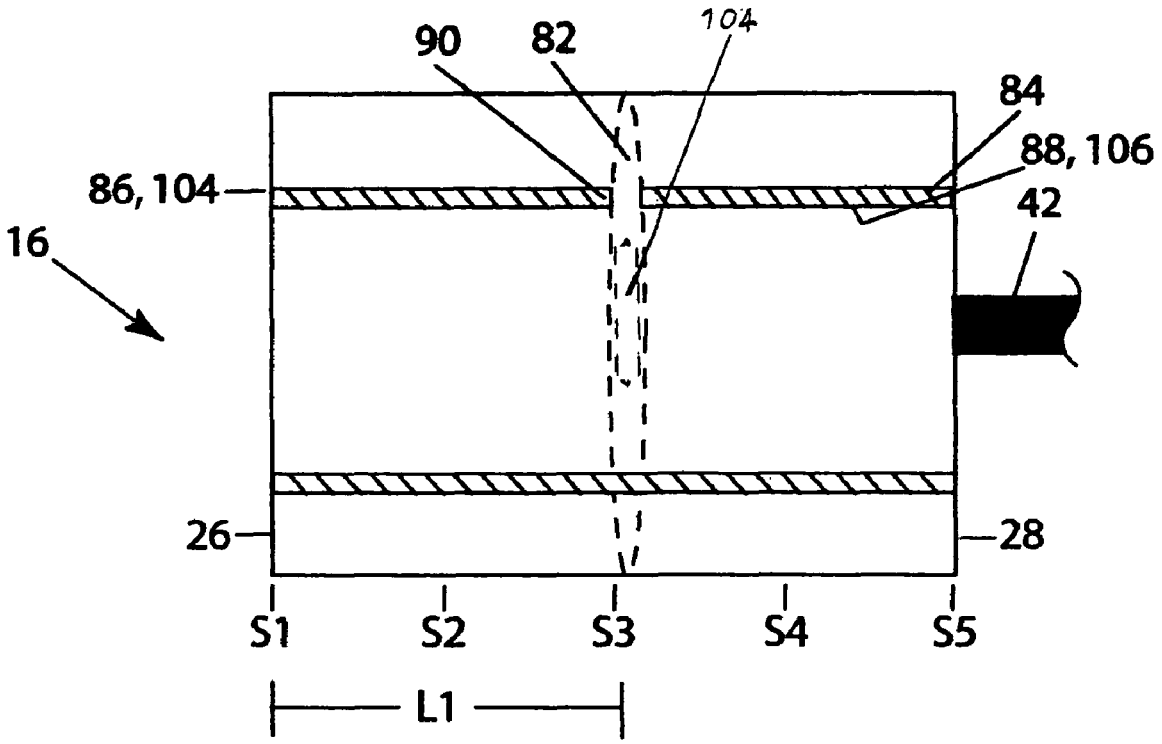
FIG. 14A is a perspective view similar to FIG. 7A, and showing a pass-through arranged on the moveable wall.
Figure 14B:
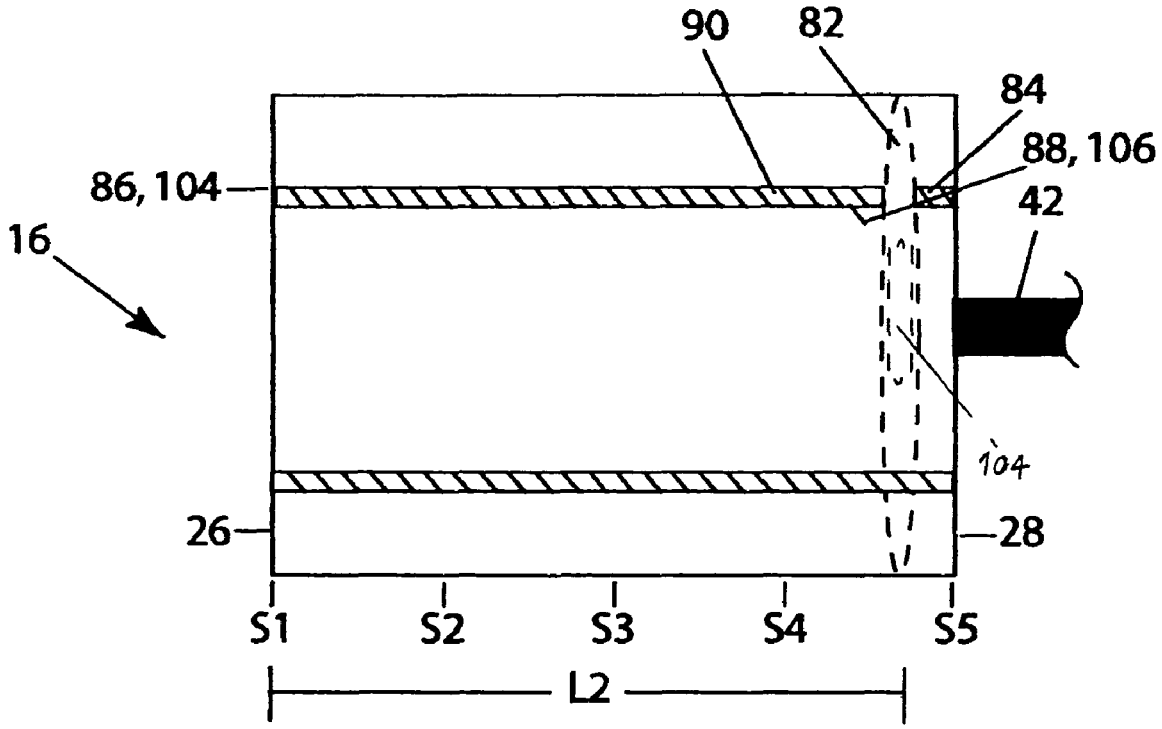
FIG. 14B is a perspective view similar to FIG. 7B, and showing a pass-through arranged on the moveable wall.

Referring to FIG. 14, a portion of the variable size drum 16 may optionally include a pass-through 104. If used, the pass-through 104 allows clothes to be more easily placed or removed from the rear of the washer dryer. For example, the variable size inner drum 16 may include a lengthwise variation mechanism or a moveable wall 82 as discussed above. Thus, the moveable wall 82 may optionally include a pass-through 104 arranged thereon through which clothes can be more easily place or removed from the rear of the washer dryer behind the moveable wall 82. The pass-through 104 may be formed as a partition or door that is electronically or mechanically and automatically or manually operated to more easily allow clothes to be placed between the moveable wall 82 and the rear of the washer dryer 10, instead of or in addition to between the moveable wall 82 and the front of the washer dryer 10. It should be noted however, that if clothes are arranged on both sides of the moveable wall 82, then the drying operation may be impacted as the inner drum 16 would not be able to increase in size for both areas where the clothes are arranged absent use of another size increasing mechanism such as those described above. Similarly, if clothes are arranged only between the moveable wall 82 and the rear of the washer dryer 10, the directional movement of the inner drum 16 should be reversed to allow for the corresponding increase in size of the inner drum 16 relative to the clothes. It should also be noted that clothes may be arranged between the moveable wall 82 and the front of the washer dryer as discussed above with or without use of the pass-through 104.

Referring to FIGS. 1 and 7-11 as discussed above such as on pages 19-23, some or all of the guidance mechanism 84 may be attached to or formed in unity with or otherwise arranged along at least a portion of the length of the drum 16 periphery. For example, some or all of the guidance mechanism 84 may be arranged within all or a portion of one or more turbulator fins. If this optional arrangement is used, direct or indirect attachment or unity formation to the inner drum may advantageously provide for space savings as the guidance mechanism 84 can be located within the otherwise unused space of inside the turbulator fin, as well as to help inhibit water damage to the enclosed guidance mechanism 84. For another example, some or all of the guidance mechanism 84 may be attached to or formed in unity with or otherwise arranged along at least a portion of other components or subcomponents of the washer dryer 10.

Referring to FIGS. 1, 7A, 7B and 11 as discussed above such as on page 23, a conduit or pipe could function as the fixed guide 88 while the leading edge of a pneumatic gas (e.g. air) or hydraulic fluid (e.g. water) could actuate or drive the moveable member 90 or function as the moveable member 90. For example, hydraulic pressure originating from the hot and cold water inlets used with the water fill hose 48 of the water handling system 18 could be used, or pneumatic pressure within the air handling system 18 could be used, or both could be used. In context of hydraulic pressure from the water handling system 18, typical household water pressure in the United States is about 45-60 psi, although it can be in the broader the range of 30-120 psi. This water pressure, readily available at the hot and cold inlets, may be used to as a hydraulic force to move the moveable portion of the moveable drum 16. The hot and/or cold inlets can be operatively connected to the inner drum by any suitable device. For example, if the actuating force used includes hydraulic pressure from the inlet(s), the water fill hose 48 may be modified to fluidly connect to the mechanism that moves the moveable drum 16, as discussed above, in addition to maintaining its function of filling the drum with wash water for the washing cycle. For another example, a split valve could connect from the inlet(s) to a separate conduit, hose, pipe or combination thereof, to direct water from the inlet(s) to hydraulically move the drum 16, as discussed above, while the other portion of the split valve maintains an independent connection with the water fill hose 48. Moreover, the inlet water pressure may be increased by reducing the diameter of the conduit, hose, pipe or combination thereof, independent of other additional pressure increasing mechanisms. As will be appreciated, the above water handling system 18 hydraulic water contextual example description could be similarly used in context of the air handling system 20 air pneumatic example description.

Referring to FIGS. 1, 3-7 and 12 as discussed above such as on page 9, the inner drum 16 is advantageously connected to a shaft 42 which, in turn, may be connected to a belt, chain or other power transmission device 44 that is driven by or directly connected to a motor. For another example, the inner drum 16 is advantageously directly connected to a belt, chain or other power transmission device 44 that is driven by the motor or shaft.

If the inner drum 16 is so connected, the depth of the washer dryer 10 may be reduced by not including the optional shaft 42. Referring to FIGS. 1 and 2, as discussed above such as on pages 14-15, the washer dryer 10 may include a variety of steps, sequences or activities such as the wash cycle and the dry cycle. For example, the washer dryer 10 may include a steam cycle preferably after the dry cycle to inhibit or remove wrinkles from the clothes.

Although this invention has been described in terms of certain exemplary uses, preferred embodiments and possible modifications thereto, other uses, embodiments and possible modifications apparent to those of ordinary skill in the art are also within the spirit and scope of this invention. It is also understood that various aspects of one or more features of this invention can be used or interchanged with various aspects of one or more other features of this invention. Accordingly, the scope of the invention is intended to be defined only by the claims that follow.

What is claimed is:

1. A combination washer dryer, comprising:

an outer drum;

a rotatable variable size inner drum arranged within the outer drum, at least a portion of the inner drum designed and constructed to move from a first position ascertainable during a wash cycle of combination washer dryer to a second position ascertainable during a dry cycle of the combination of the washer dyer, wherein a range of motion of the variable size inner drum from the first position to the second position is effective to increase a size of the inner drum portion that holds an amount of clothes, the clothes held within the portion of the inner drum defined between a front end of the inner drum and the at least a portion of the inner drum designed and constructed to move from the first position to the second position;

a water handling system adapted to intake water into the inner or outer drum and to remove water from the inner or outer drum; and an air handling system adapted to intake air into the inner or outer drum and to remove air from the inner or outer drum.

2. The washer dryer of claim 1, wherein the variable size inner drum size has a variable length.

3. The washer dryer of claim 2, wherein the variable size inner drum comprises a first portion that coaxially overlaps a second portion.

4. The washer dryer of claim 3, wherein the second portion of the variable size inner drum is moved by a telescoping shaft.

5. The washer dryer of claim 2, wherein the variable size inner drum comprises a unitary member having a plurality of telescoping sections.

6. The washer dryer of claim 2, wherein the variable size inner drum comprises a resilient or deformable material.

7. The washer dryer of claim 2, wherein the variable size inner drum has a moveable wall disposed between a the front end of the variable size inner drum and a rear end of the variable size inner drum.

8. The washer dryer of claim 7, wherein the moveable wall is guided by a guidance mechanism and urged by an actuating force, the guidance mechanism and actuating force effective to effectuate an increase in the size of the inner drum.

9. The washer dryer of claim 8, wherein the fixed guide and moveable member comprise a trolley track busway.

10. The washer dryer of claim 8, wherein the fixed guide and moveable member comprise a rack and pinion assembly.

11. The washer dryer of claim 8, wherein the fixed guide comprises a pipe and the actuating force is selected from the group consisting of: pneumatics and hydraulics.

12. The washer dryer of claim 8, wherein the moveable wall is guided by a guidance mechanism comprising a moveable guide attached to the variable size inner drum and a fixed member attached to or formed in unity with the moveable guide and the moveable wall.

13. The washer dryer of claim 12, wherein the moveable guide and fixed member comprise an endless chain formed of a plurality of links and driven by a plurality of cogs.

14. The washer dryer of claim 1, wherein the variable size inner drum has a variable diameter.

15. The washer dryer of claim 1, wherein the size of the variable size inner drum is varied between a wash cycle and a heat dry cycle.

16. The washer dyer of claim 1, wherein a supplemental drying mechanism is used during the drying cycle, the supplemental drying mechanism utilizing an energy source selected from the group consisting of: microwave, ultraviolet, infrared and ultrasonic.

17. The washer dyer of claim 1, wherein at least a portion of a guidance mechanism is arranged within at least a portion of a turbulator fin of the washer dryer.

18. A combination washer dryer, comprising:

an outer drum;

a rotatable variable size inner drum arranged within the outer drum, at least a portion of the inner drum designed and constructed to move from a first position ascertainable during a wash cycle of the combination washer dryer to a second position ascertainable during a dry cycle of the combination of the washer dyer, wherein a range of motion of the variable size inner drum from the first position to the second position is effective to increase a size of the inner drum portion that holds an amount of clothes, the clothes held within the portion of the inner drum defined between a rear end of the inner drum and the at least a portion of the inner drum designed and constructed to move from the first position to the second position;

a water handling system adapted to intake water into the inner or outer drum and to remove water from the inner or outer drum; and an air handling system adapted to intake air into the inner or outer drum and to remove air from the inner or outer drum, wherein the clothes are held within the portion of the inner drum defined between the rear end of the inner drum and the at least a portion of the inner drum designed and constructed to move from the first position to the second position.

19. The washer dryer of claim 1, wherein the inner drum comprises a pass-through to assist placement of the clothes between the rear end of the inner drum and the at least a portion of the inner drum designed and constructed to move from the first position to the second position.

20. A variable size drum for use in a combination washer dryer, comprising:

a rotatable chamber for holding an amount of clothes and having a plurality of holes arranged on the chamber to allow air or water to pass in or out of the chamber; and an element arranged within or in unity with or connected to the chamber that is movable from a first position ascertainable during a wash cycle of the combination washer dryer to a second position ascertainable during a dry cycle of the combination washer dryer, whereby when the element is moved from the first position to the second position the volume of the variable size drum that holds the clothes is increased.

* * * * *